US005249018A

United States Patent [19]

Watanabe

[11] Patent Number: 5,249,018

[45] Date of Patent: Sep. 28, 1993

[54] ELECTROPHOTOGRAPHIC IMAGE FORMING APPARATUS WITH USER-ADJUSTABLE FORMING CONDITION DEFAULT

[75] Inventor: Yasuhiko Watanabe, Yokohama, Japan

[73] Assignee: Kabushiki Kaisha Toshiba, Kawasaki, Japan

[21] Appl. No.: 931,379

[22] Filed: Aug. 18, 1992

[30] Foreign Application Priority Data

Aug. 19, 1991 [JP] Japan ..... 3-206812

[51] Int. Cl.[5] ..... G03G 21/00

[52] U.S. Cl. ..... 355/208; 355/204

[58] Field of Search ..... 355/203, 204, 208, 246, 355/214

[56] References Cited

U.S. PATENT DOCUMENTS 4,693,592 9/1987 Kurpan ..... 355/208
4,833,506 5/1989 Kuru et al. ..... 355/208
4,932,356 6/1990 Watanabe et al. ..... 355/208 X
4,975,747 12/1990 Higuchi ..... 355/246
4,982,232 1/1991 Naito ..... 355/208
5,028,960 7/1991 Yasuda et al. ..... 355/246

*Primary Examiner*—A. T. Grimley
*Assistant Examiner*—Sandra L. Brase
*Attorney, Agent, or Firm*—Foley & Lardner

[57] ABSTRACT

The image forming apparatus includes a unit for radiating light to an original with plural lighting conditions, a unit for changing the lighting condition according to a concentration of the original and reference exposure data, a unit for storing the reference exposure data, a unit for forming an image on an image carrier under different image forming conditions, using light radiated by the radiating unit and sent via the original, a unit for changing in a first mode the image forming conditions, and changing in a second mode the reference exposure data stored by the storing unit, and a unit for switching the first and second modes so as to change the operation of the changing unit.

10 Claims, 9 Drawing Sheets

ELECTROPHOTOGRAPHIC IMAGE FORMING APPARATUS WITH USER-ADJUSTABLE FORMING CONDITION DEFAULT

BACKGROUND OF THE INVENTION

1. Field of the Invention

The present invention relates to an image forming apparatus wherein a user can suitably change reference adjustment data of exposure reference, toner density reference, etc. by operating a combination of various keys provided originally on an operation panel.

2. Description of the Related Art

In general, an image forming apparatus represented by an electronic copying apparatus has an auto exposure adjustment function and a manual exposure adjustment function. This type of electronic copying apparatus is disclosed, for example, in U.S. Pat. No. 4,627,713. In addition, there has been proposed an electronic copying apparatus having a function of detecting the density of toner in a developing device and controlling addition of toner. An example of this electronic copying apparatus is disclosed in Japanese Patent Application No. 300712/89 filed Nov. 21, 1989 by the same applicant as the present application.

In the case of new copying apparatuses or copying apparatuses just after periodic maintenance service, satisfactory copies are normally obtained by auto exposure or standard set values of manual exposure (default values; manual center). However, after a number of copies have been made, the brightness (density) of a copied image varies due to a variation in characteristics of a developer, deterioration of characteristics of a photosensitive drum, etc., even if an exposure lamp is stably driven by the same voltage.

When satisfactory copies are not obtained by auto exposure or standard set values of manual exposure, each user must adjust the exposure amount in the manual exposure adjustment mode before taking a copy, though this is troublesome. However, several copies must be produced on trial until the user can understand the degree by which the exposure amount should be corrected. Thus, erroneous copies are produced, at the beginning, due to auto exposure or standard set values of manual exposure.

SUMMARY OF THE INVENTION

The object of the present invention is to provide an image forming apparatus wherein a user can suitably change standard set values (reference adjustment data) which are default values, by operating a combination of various keys provided on an operation panel, and not by periodic maintenance service, thereby preventing production of erroneous copies.

To achieve the above object, an image forming apparatus includes means for radiating a light to an original, means for detecting a quantity of the light reflected from the original, means for storing a reference value of a quantity of the light, means for determining the quantity of the light being radiated by the radiating means in accordance with a comparison the quantity of the light detected by the detecting means to the reference value stored in the storing means, means for forming an image on an image carrier in one of a plurality of image forming conditions, using the light reflected from the original when the radiating means radiates the light in the quantity determined by the determining means, means for generating a signal, means for controlling the forming means to change the image forming condition corresponding to the signal generated by the generating means in a first mode, and controlling the storing means to change the reference value stored in the storing means corresponding to the signal generated by the generating means in a second mode, and means for switching between the first and second modes of the controlling means.

The reference value (reference exposure data, etc.) stored in the storing means is changed by operating the controlling means (predetermined one of mode-setting keys).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1:
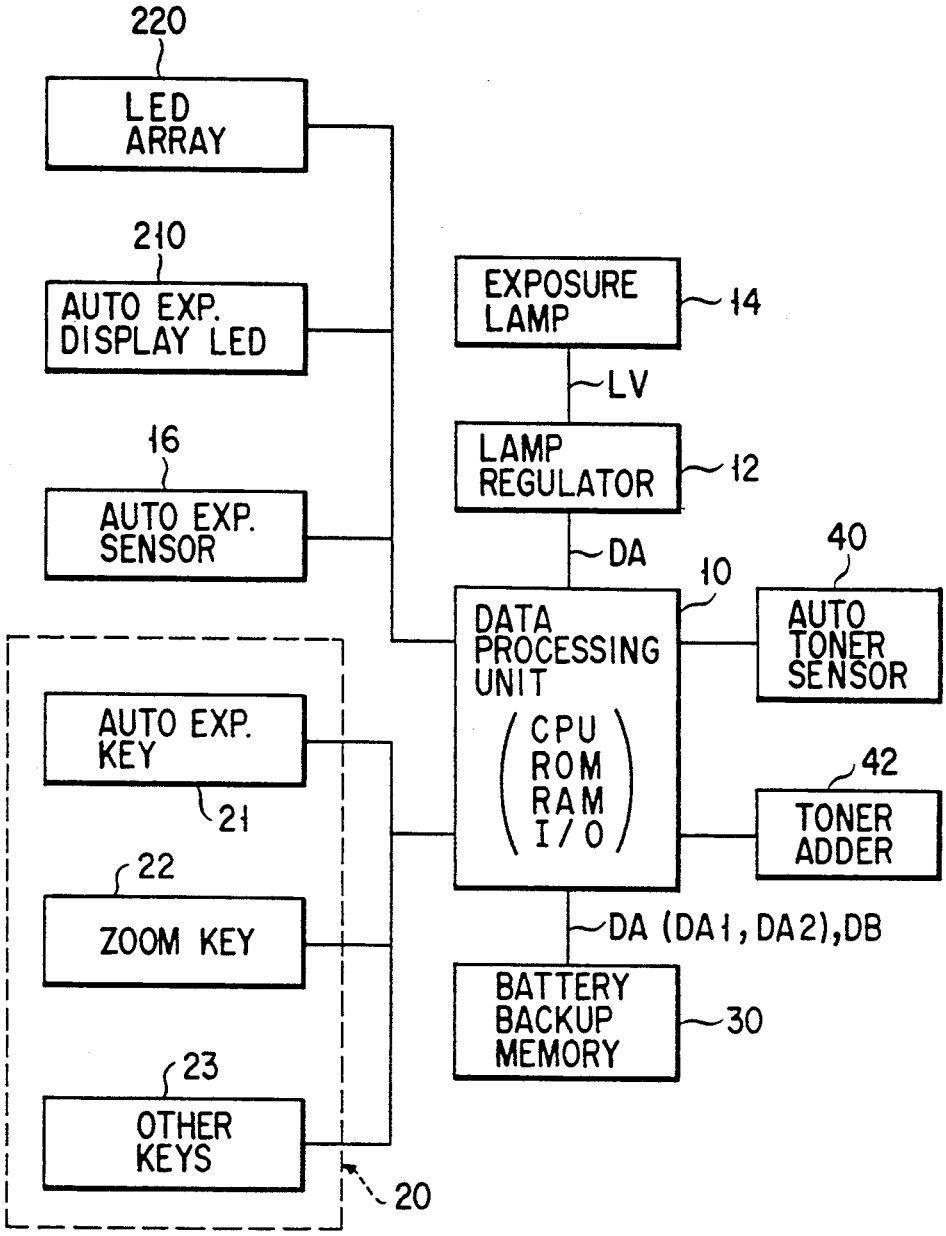
FIG. 1 is a block diagram showing an electronic copying apparatus functioning as an image forming apparatus according to an embodiment of the present invention.

FIG. 1 schematically shows an exposure control system and a toner addition control system in an electronic copying apparatus functioning as an image forming apparatus according to an embodiment of the present invention.

A data processing unit 10 is constituted by a CPU and peripheral circuits (ROM, RAM, I/O, etc. not shown)

which execute predetermined programs. The data processing unit 10 controls the entire copying apparatus.

The data processing unit 10 is connected to an exposure lamp 14 via a lamp regulator 12. In addition, the data processing unit 10 is connected to an auto exposure sensor 16, an auto exposure display LED 210, an auto toner sensor 40, a toner supplier 42, a battery backup RAM (or EEPROM) 30, various set keys 20 of the copying apparatus, and an LED array 220 for displaying adjustment amounts input by any of the keys 20.

Figure 2:
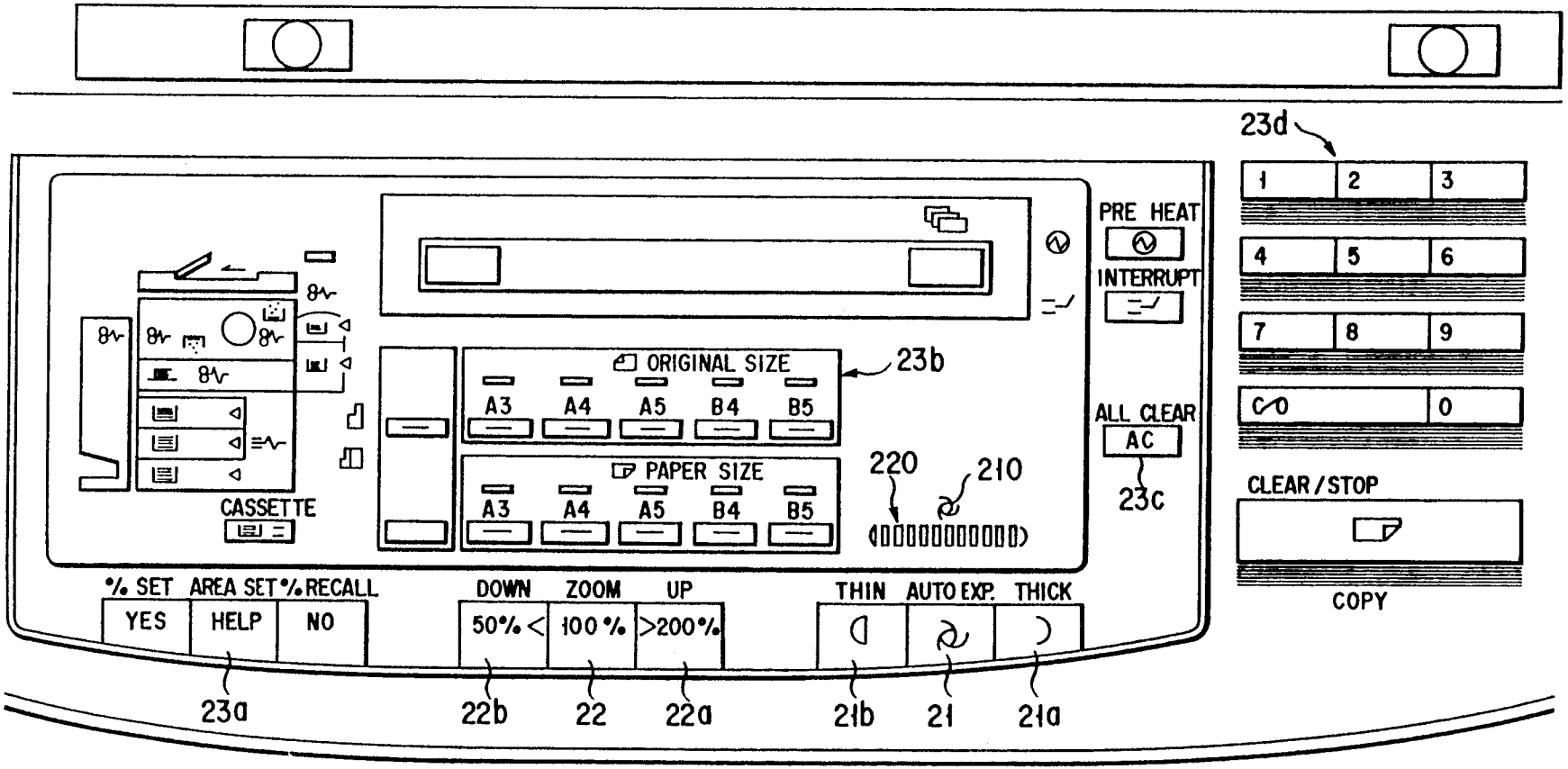
FIG. 2 shows an operation panel of the electronic copying apparatus shown in FIG. 1.

FIG. 2 shows an example of arrangement of the set keys 20 on the operation panel of the electronic copying apparatus shown in FIG. 1.

When the auto exposure key 21 is depressed, a signal is generated and the auto exposure display LED 210 is lighted and the auto exposure mode is initiated corresponding to the signal. When the auto exposure key 21 is depressed once again, a signal is generated and the auto exposure display LED 210 is turned off and the manual exposure mode is restored corresponding to the signal. In the manual exposure mode, density (deep, light) keys 21*a* and 21*b* are operated to increase and decrease data DA delivered from the processing unit 10 to the lamp regulator 12. Thus, the driving voltage LV of the lamp 14 is varied, thereby adjusting the lightness of the copied image.

A zoom key 22 is depressed when the user changes the enlargement/reduction ratio of copy. By operating up/down keys 22*a* and 22*b* arranged on the left and right of the key 22, the enlargement/reduction ratio can be varied in units of 1%.

The operation panel shown in FIG. 2 has, in addition, various mode setting keys (20) such as a help key 23*a* for furnishing the user with operation-related comments, a size setting key 23*b* for designating the original size, sheet size, etc., an all-clear key 23*c* for resetting various set values to standard values (default values based on the data in memory 30), and numeral keys 23*d* for designating the number of copies.

Figure 3:
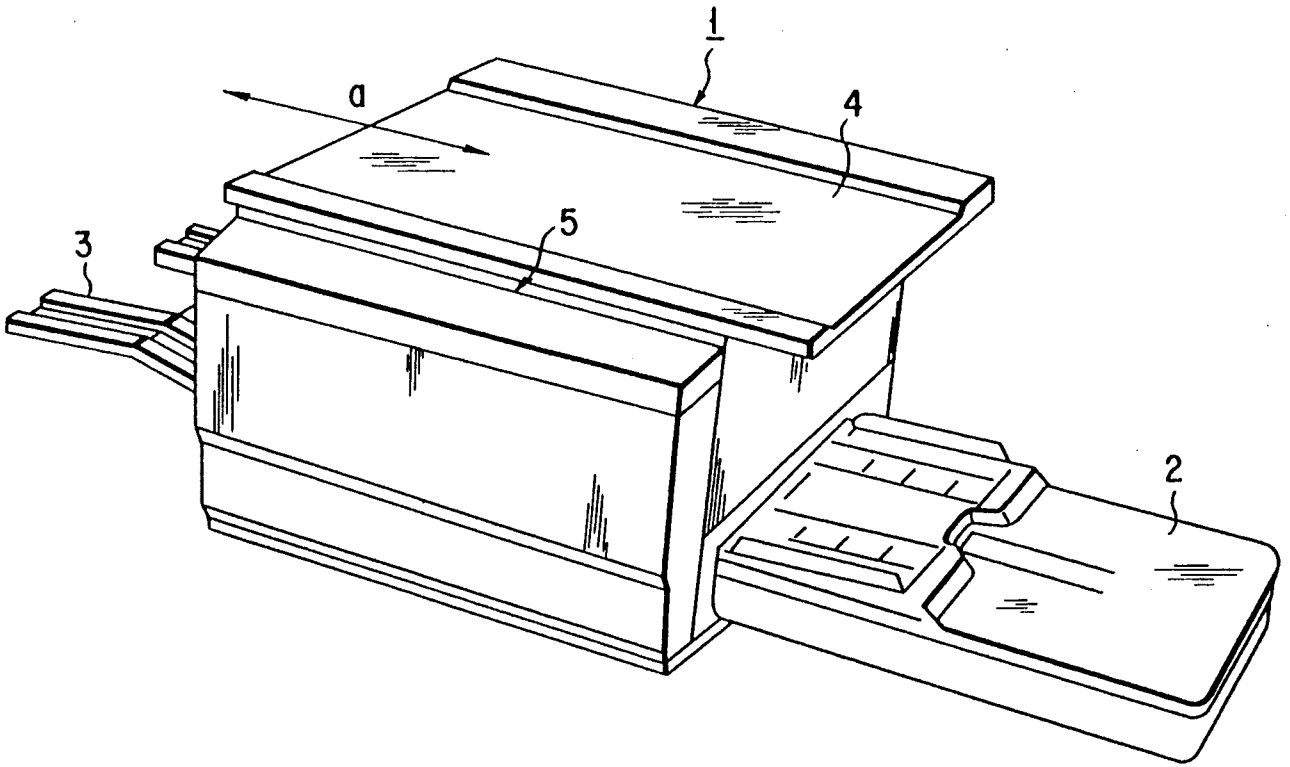
FIG. 3 is a perspective view showing an external appearance of the electronic copying apparatus shown in FIG. 1.

FIG. 3 shows an external appearance of the electronic copying apparatus. In FIG. 3, an automatic/-manual paper feed cassette 2 is mounted on the right-side surface of a copying apparatus body 1. A paper discharge tray 3 is mounted on the left-side surface of the body 1. An original table 4, which is reciprocally movable in the direction of double-headed arrow a, and an operation panel 5 are provided on the upper part of the body 1. The operation panel 5 is provided with various keys and display devices, as shown in FIG. 2.

Figure 4:
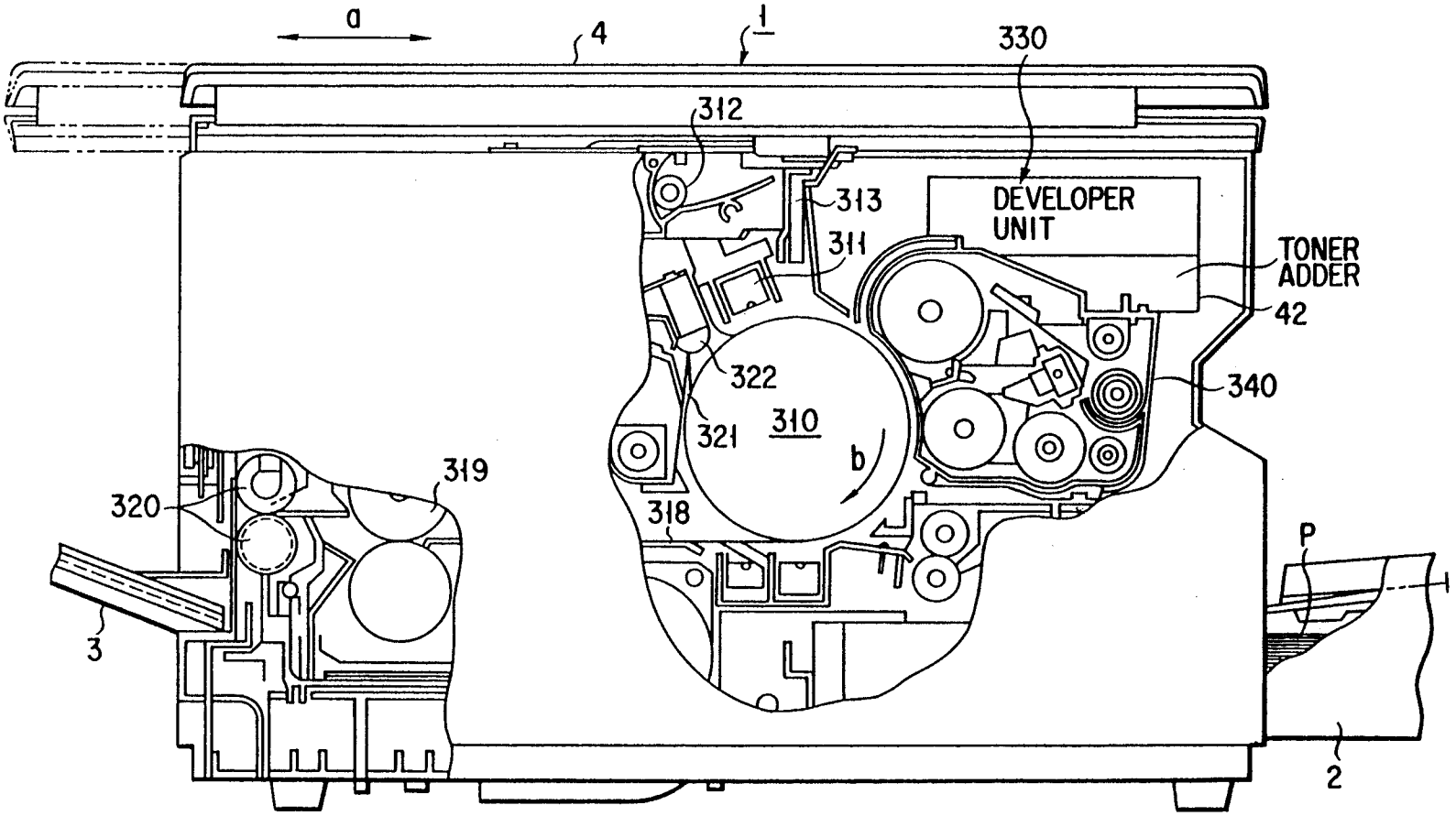
FIG. 4 is a cross-sectional side view showing schematically the internal structure of the electronic copying apparatus shown in FIG. 3.

FIG. 4 shows an example of the internal structure of the copying apparatus body 1. A drum-shaped photosensitive body 310 functioning as an image carrying body, which is supported rotatably, is provided at a center area of the copying apparatus body 1. The photosensitive body 310 is rotated by a driving mechanism (not shown) in the direction of arrow b in synchronism with the original table 4.

The photosensitive body 310 is uniformly charged by a charger 311. An image of an original obtained by light irradiated from an exposure lamp 312 is formed on the photosensitive body 310 by a convergent light transmission unit 313 which constitutes an optical system. Thus, an electrostatic latent image is formed on the surface of the photosensitive body 310. The variation in image density in the above-mentioned auto exposure mode and manual exposure mode is effected by changing the light amount of the exposure lamp 312.

The latent image formed on the surface of the photosensitive body 310 is provided with toner by a developer unit 330 situated in contact with the periphery of the developer unit 310. Thus, the latent image is developed (i.e. a toner image is produced). The toner image is shifted towards a transfer charger 314 by rotation of the photosensitive body 310.

On the other hand, a paper sheet P fed out of the paper feed cassette (or fed manually) is guided by a pair of resist rollers 316 towards the transfer charger 314 with a predetermined timing. The paper P is brought into close contact with the photosensitive body 310, whereby the toner image is transferred onto the paper sheet P by the function of the transfer charger 314.

The paper sheet P after transfer is peeled from the photosensitive body 310 by a peeling charger 317 which employs an AC corona discharge, and is conveyed along a convey path 318. The sheet P is passed through a fixing unit 319 and the toner image is fixed on the sheet P by melting of toner. Thus, the paper sheet P on which the image is formed is discharged as an output copy onto the discharge tray 3 by a pair of discharge rollers 320.

Toner remaining on the surface of the photosensitive body 310, on which image formation is finished, is removed by a cleaning unit 321. Further, the surface potential of the photosensitive body 310 is decreased to a predetermined level or less by a de-electrifying lamp 322. Thus, the next copying operation is enabled.

Figure 5:
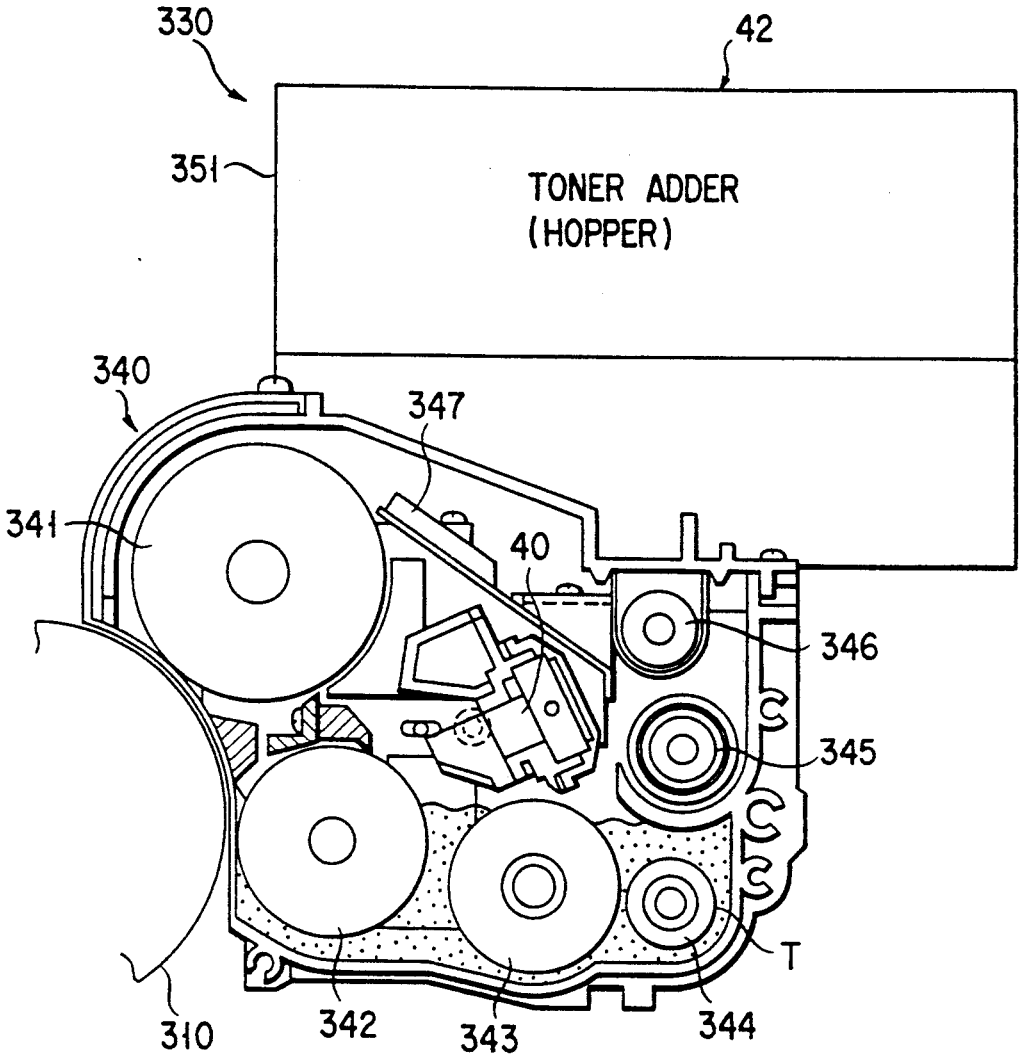
FIG. 5 schematically shows a developing device of the electronic copying apparatus shown in FIG. 1.

FIG. 5 shows an example of the structure of the developer unit 330. The developer unit 330 is constituted by a developing device 340, which uses a two-component developing agent consisting of toner T and a carrier, and a toner supplier 42 for replenishing toner T into the developing device 340.

Specifically, the developing device 340 comprises upper and lower magnet rollers 341 and 342, which face an opening portion of the photosensitive body 310, small and large paddles 343 and 344, a mixing auger 345, a toner convey auger 346, and a scraper 347. An automatic toner sensor 40 of, e.g. magnetic permeability measurement type for automatically detecting the density of toner in the developing device 340 is provided within the developing device 340.

As mentioned above, the automatic toner sensor 40 is connected to the data processing unit 10. The data processing unit 10 compares the density of toner detected by the auto toner sensor 40 and the reference value of the toner density stored in the memory 30. The data processing unit 10 controls the toner supplier 42 for supplying the toner T to the developing device 340 in accordance with the comparison. If the value of the detected toner density is lower than the reference value, the data processing unit 10 commands the toner supplier to supply the toner T to the developing device 340.

Figure 6:
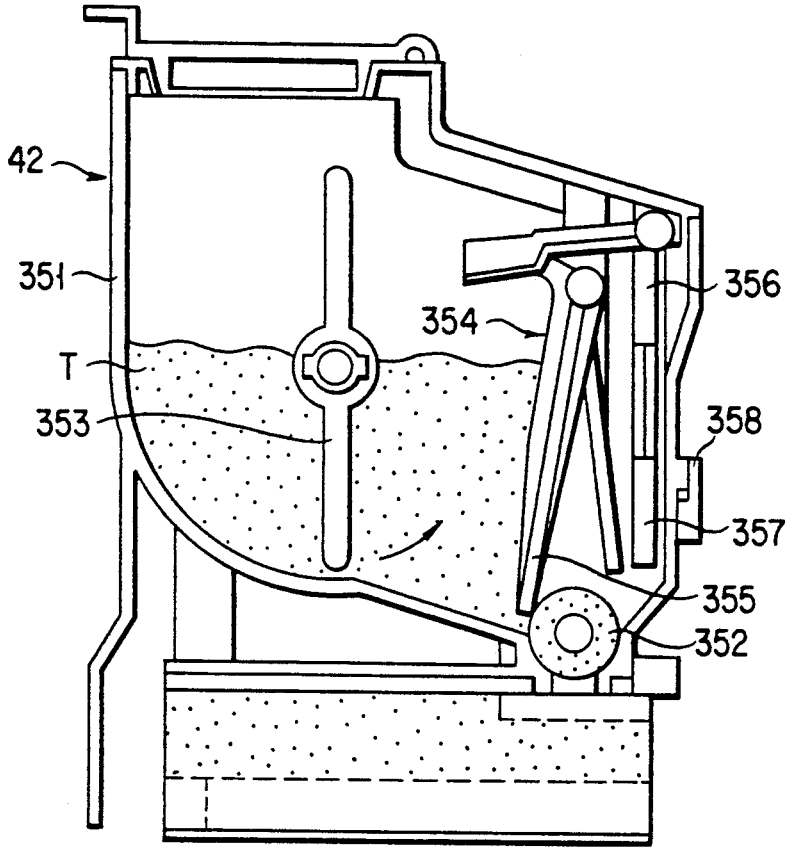
FIG. 6 schematically shows a toner adder of the electronic copying apparatus shown in FIG. 1.

As is shown in FIG. 6, the toner supplier 42 comprises a hopper 351, a toner adding roller 352 provided at a lower part of the inside of the hopper 351, and a toner mixer 353 for stirring toner T so as to supply toner T towards the toner adding roller 352.

A toner empty mechanism 354 for sensing the state in which the remaining amount of toner T is less than a predetermined level is provided within the hopper 351. The toner empty mechanism 354 comprises a toner empty lever 355 which rotates in accordance with the remaining amount of toner T, a toner empty actuator 356 which operates following the motion of the toner empty lever 355, a permanent magnet 357 attached to a tip portion of the toner empty actuator 356, and a lead switch 358 provided outside the hopper 351 in such a position as to face the permanent magnet 357.

When the toner T is sufficient in the hopper 351, toner T enters the space between the permanent magnet 357 attached to the tip portion of the toner empty actuator 356 and the lead switch 358, and, as a result, the lead switch 358 is turned off. When the toner T in the hopper 351 reduces, the permanent magnet 357 comes into close contact with the lead switch 358. Thus, the lead switch 358 is turned on. The toner empty state is sensed by the turning on of the switch 358.

FIG. 7 shows examples of display on the operation panel at the time the user suitably changes the reference adjustment data (reference data of auto exposure or center value of manual exposure) of the electronic copying apparatus shown in FIG. 1.

When the reference data of auto exposure (default data DA1 stored in memory 30) is finely adjusted, the auto exposure key (auto key) 21 is depressed once during standby of the apparatus, unless the auto exposure mode is currently set. Then, the auto exposure display LED 210 is turned on.

Figure 7A:
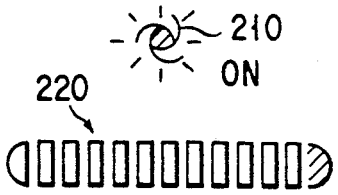
FIGS. 7A to 7H show examples of display on the operation panel at the time the user suitably changes the reference adjustment data (reference data of auto exposure or center value of manual exposure) of the electronic copying apparatus shown in FIG. 1.
Figure 7E:
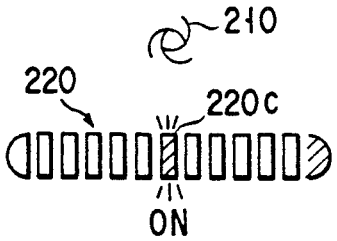
Figure 7B:
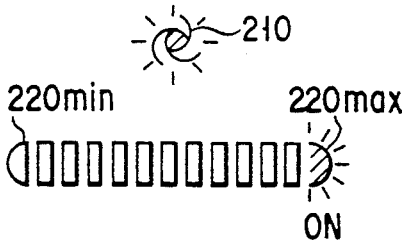

When the zoom up key 22*a* is depressed while the auto key 21 is being depressed, a zoom maximum LED 220 max is turned on (FIG. 7B). When the zoom down key 22*b* is depressed while the auto key 21 is depressed, a signal is generated and a zoom minimum LED 220 min is turned on corresponding to the signal. When the key 22*a* or 22*b* is released, the LED 220 max or 220 min is turned on. Thus, when the LED 220 max is flickered once, the auto exposure reference data DA1 increases by a predetermined value corresponding to the signal. When the LED 220 min is flickered once, the auto exposure reference data DA1 decreases by a predetermined value corresponding to the signal.

Thereafter, when the zoom up key 22*a* is depressed repeatedly (or the key 22*a* is depressed continuously) with the auto key 21 depressed, a signal is generated and the auto exposure reference data DA1 increases little by little corresponding the the signal. When the data DA1 reaches an upper limit, the zoom maximum LED 220 max starts to flicker (FIG. 7C).

Similarly, when the zoom down key 22*b* is depressed repeatedly after the LED 220 min is flickered, the auto exposure reference data DA1 decreases gradually. When the data DA1 reaches a lower limit, the zoom minimum LED 220 min starts to flicker.

When the key 21 or key 22 is released (i.e. when at least one of the keys 21 and 22 is turned off) before the LED 220 max or LED 220 min starts to flicker, the data DA1 at this moment is written in the battery backup memory 30 as updated exposure reference data DA. When either key 21 or key 22 is released and a predetermined time has passed, the display returns to the state of FIG. 7A (FIG. 7D).

In the case where the reference data (default data DA2 stored in the memory 30) for manual exposure is finely adjusted by the user, if the apparatus is currently in the standby state in the auto exposure mode, the auto exposure key (auto key) 21 is depressed once. (When the LED 210 is off, the apparatus has already been in the manual exposure mode and therefore the auto key 21 is not depressed.) Then, the auto exposure display LED 210 is turned off, and instead a manual center LED 220*c* situated at the center of the LED array 220 is turned on and the apparatus is set in the manual exposure mode (FIG. 7E).

Figure 7F:
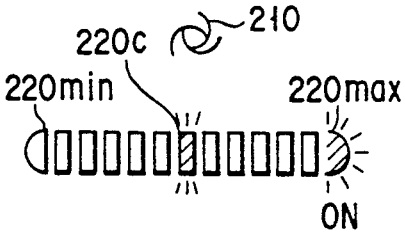
Figure 7C:
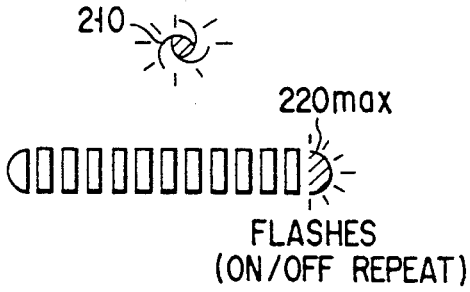

When the zoom up key 22*a* is depressed with the auto key 21 depressed, the zoom maximum LED 220 max, in addition to the manual center LED 220*c*, is turned on (FIG. 7F). On the other hand, when the zoom down key 22*b* is depressed with the auto key 21 depressed, the zoom minimum LED 220 min, in addition to the manual center LED 220*c*, is turned on.

Figure 7G:
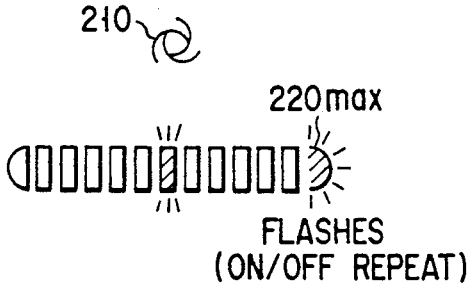
Figure 7D:
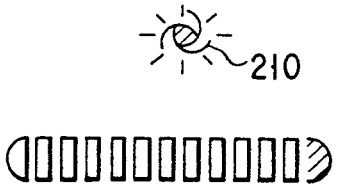

If the key 22*a* is depressed repeatedly after the LED 220 max is turned on, the manual exposure reference data DA2 increases gradually. When the data DA2 reaches an upper limit, the zoom maximum LED 220 max starts to flicker (FIG. 7G).

Similarly, if the zoom down key 22*b* is depressed repeatedly after the LED 220 min is turned on, the manual exposure reference data DA2 decreases gradually. When the data DA2 reaches a lower limit, the zoom minimum LED 220 min starts to flicker.

Figure 7H:
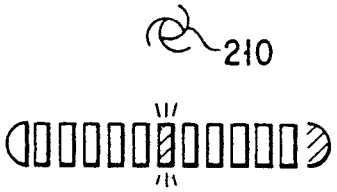

When the key 21 or key 22 is released (i.e. when at least one of the keys 21 and 22 is turned off) before the LED 220 max or LED 220 min starts to flicker, the data DA2 at this moment is written in the battery backup memory 30 as updated exposure reference data DA. When either key 21 or key 22 is released and a predetermined time has passed, the display returns to the state of FIG. 7E (FIG. 7H).

In each of the auto and manual modes, if the data DA increases, the image of the resultant copy becomes lighter. If the data DA decreases, the image of the resultant copy becomes darker.

Figure 8:
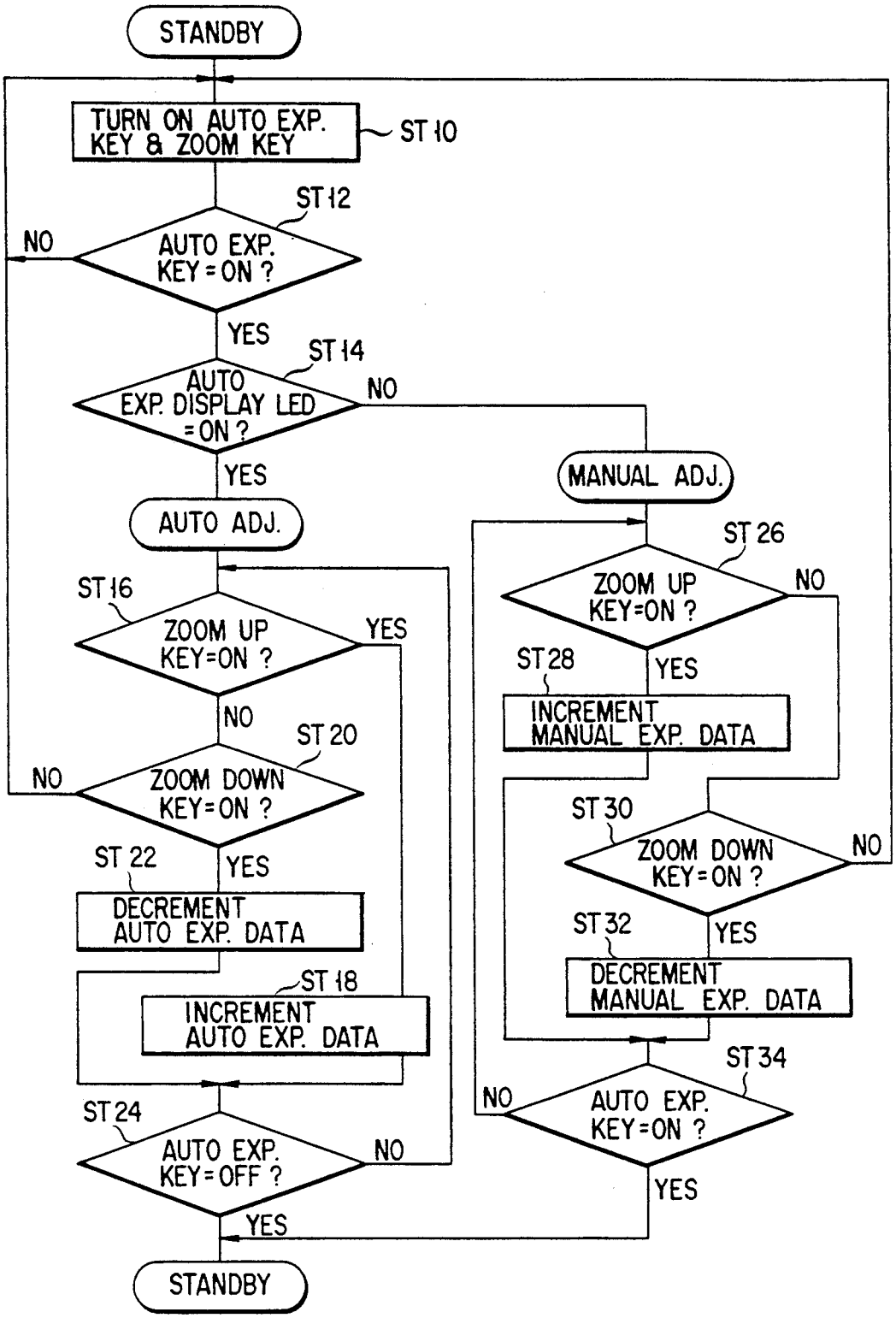
FIG. 8 is a flow chart illustrating the steps by which the user changes the reference data of auto exposure and center value of manual exposure in the electronic copying apparatus shown in FIG. 1.

FIG. 8 is a flow chart illustrating the steps by which the user changes the reference data of auto exposure and center value (50%) of manual exposure in the electronic copying apparatus shown in FIG. 1.

In the standby state, the auto exposure key 21 and zoom key 22 are turned on (ST10). If the auto exposure key 21 is released ("NO" in ST12), the control routine returns to the standby state.

If the auto exposure key 21 remains on ("YES" in ST12) and the auto exposure display LED 210 is on ("YES" in ST14), the auto exposure adjustment mode is initiated.

When the zoom up key 22*a* is once turned on in the auto exposure adjustment mode ("YES" in ST16), the auto exposure reference data DA1 increases by a predetermined value (ST18).

For example, suppose that the data DA1 has an 8-bit structure (256 steps of "0" to "255") and the initial value (the default value set by a serviceman) just after power-on is set at the 128th step. In this case, the data DA1 increases in units of two steps, each time the zoom up key 22*a* is once turned on while the auto exposure key 21 is being turned on.

In the auto exposure adjustment mode, if the zoom up key 22*a* is not turned on ("NO" in ST16) but the zoom down key 22*b* is once turned on ("YES" in ST20), the auto exposure reference data DA1 decreases by a predetermined value (ST22). For example, each time the zoom down key 22*b* is once turned on, the data DA1 decreases in units of two steps.

When desired auto exposure reference data DA1 is obtained by the operation of step ST18 or ST22, the auto exposure key 21 is turned off ("YES" in ST24) and the control routine returns to the standby state.

If the auto exposure key 21 remains on ("YES" in ST12) and the auto exposure display LED 210 is off ("NO" in ST14), the manual exposure adjustment mode is initiated.

When the zoom up key 22*a* is once turned on in the manual exposure adjustment mode ("YES" in ST26), the manual exposure reference data DA2 increases by a predetermined value (ST28).

For example, suppose that the data DA2 has an 8-bit structure and the default value (manual center) is set at the 128th step. In this case, the data DA2 increases in units of two steps, each time the zoom up key 22*a* is once turned on while the auto exposure key 21 is being turned on.

In the manual exposure adjustment mode, if the zoom up key 22*a* is not turned on ("NO" in ST26) but the zoom down key 22*b* is once turned on ("YES" in ST30), the manual exposure reference data DA2 decreases by a predetermined value (ST32). For example, each time the zoom down key 22*b* is once turned on, the data DA2 decreases in units of two steps.

When desired manual exposure reference data DA2 is obtained by the operation of step ST28 or ST32, the auto exposure key 21 is turned off ("YES" in ST34) and the control routine returns to the standby state.

In the above description, the variable range of the exposure reference data DA (8 bits) is two steps; however, it may vary from "1" step to "255" steps.

As has been stated above, even in the case where a clear copy is not obtained in the reference set state (initialized state) just after the power-on due to contamination of the optical system, etc., a clear copy can be obtained in the reference set state without help of servicemen, once the user himself changes values stored in the memory 30 of the exposure reference data DA (DA1 and/or DA2).

Figure 9:
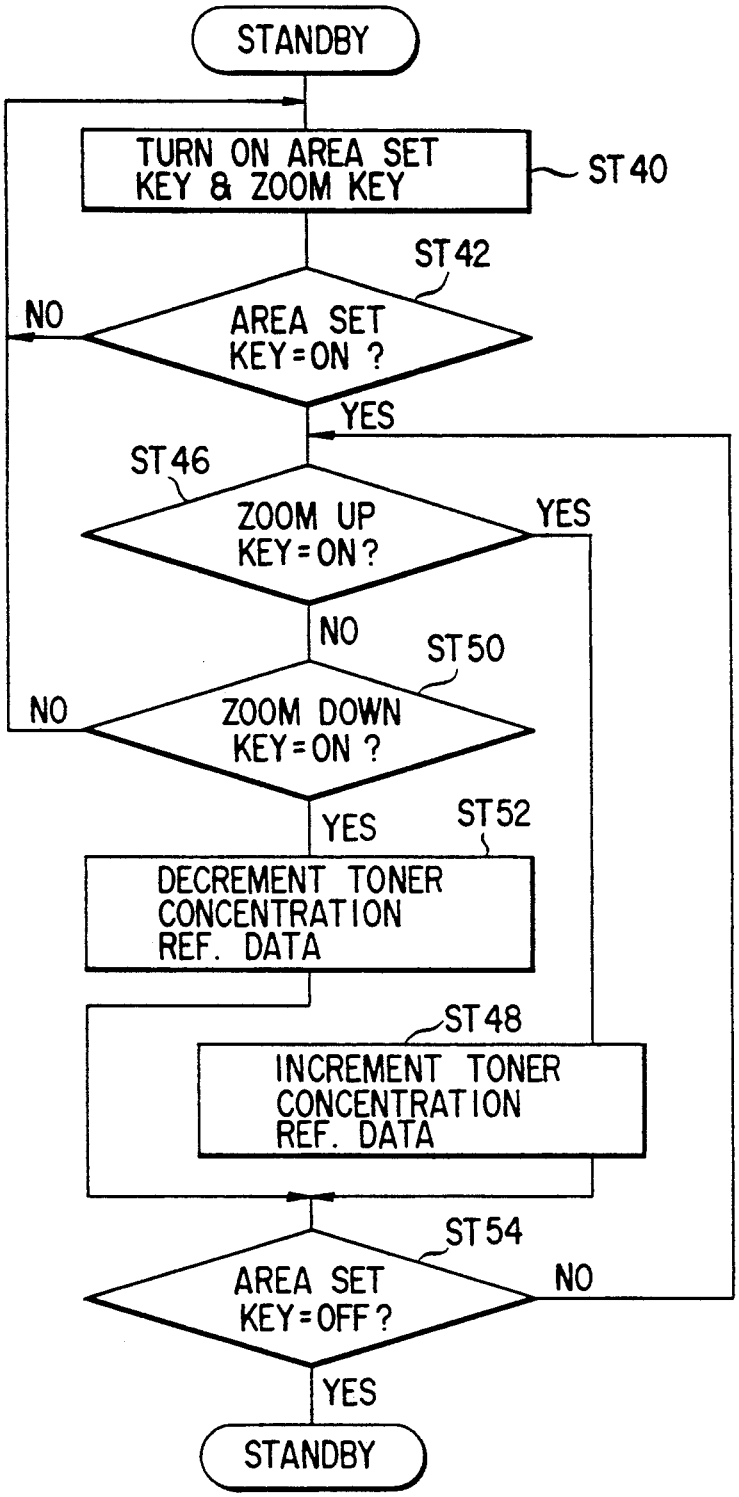
FIG. 9 is a flow chart illustrating the steps by which the user changes the reference data of toner density in the electronic copying apparatus shown in FIG. 1.

FIG. 9 is a flow chart illustrating the steps by which the user changes the reference data of toner density in the electronic copying apparatus shown in FIG. 1.

In the standby state, area set key 23*a* and zoom key 22 are turned on (ST40). If the area set key 23*a* is released thereafter, the control routine returns to the standby state ("NO" in ST42).

If the zoom up key 22*a* is once turned on ("YES" in ST46) while the area set key 23*a* is being turned on ("YES" in ST42), the toner density adjustment mode is initiated and the toner density reference data DB is increased by a predetermined value (ST48).

For example, suppose that the data DB has an 8-bit structure and the default value is set at the 128th step. In this case, the data DB increases in units of two steps, each time the zoom up key 22*a* is once turned on while the area set key 23*a* is turned on.

In the toner density adjustment mode, when the zoom up key 22*a* is not turned on ("NO" in ST46) but the zoom down key 22*b* is once turned on ("YES" in ST50), the toner density reference data DB decreases by a predetermined value (ST52). For example, the data DB decreases in units of two steps each time the zoom down key 22*b* is once turned on.

When desired toner density reference data DB is obtained by the operation of step ST48 or ST52, the area set key 23*a* is turned off ("YES" in ST54) and the control routine returns to the standby state.

As has been stated above, even in the case where a clear copy is not obtained in the reference set state just after the power-on due to a variation in characteristics of developer agent, etc., a clear copy can be obtained in the reference set state without help of servicemen, once the user himself changes values stored in the memory 30 of the toner density reference data DB.

As has been described above, according to the present invention, the user can suitably change, by a combination of keys originally provided on the operation panel, that portion (exposure reference data, toner density reference data, etc.) of the data accessible only to servicemen in the prior art, which portion may be changed by the user with no problem.

Therefore, when a constant variation in lightness (density) of copy occurs due to a time-based variation such as contamination of the optical system, the user himself can perform adjustment to prevent erroneous copying resulting from the time-based variation, etc., without the help of servicemen.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An image producing apparatus comprising:

an image carrier;

means for processing an image on said image carrier when said image carrier is in one of said first and second image processing conditions;

a user operable first key for setting the first image processing condition;

a user operable second key for setting the second image processing condition;

means for setting a mode for changing the image processing conditions in accordance with a combination of the first and second keys;

means for modifying, using the second key, the one image processing condition of said processing means when the image processing condition changing mode is set by said setting means; and means for retaining, using the first key, the image processing condition modified by said modifying means.

2. An image forming apparatus comprising:

means for radiating light to an original;

means for detecting a quantity of the light reflected from the original;

means for storing a reference value of a quantity of the light;

means for determining the quantity of the light being radiated by said radiating means in accordance with a comparison to the quantity of light detected by said detecting means to the reference value stored in said storing means;

means for forming an image on an image carrier in one of a plurality of image forming conditions, using the light reflected from the original when said radiating means radiates the light in the quantity determined by the determining means;

wherein said forming means includes:

means for setting a mode for changing the quantity of the light being radiated by the radiating means in accordance with a combination of said first and second keys;

means for modifying, using said second key, the quantity of the light being radiated by the radiating means when the light quantity changing mode is set by said setting means; and means for retaining, using said first key, the quantity of the light modified by said modifying means;

means for generating a signal, said generating means including a first key for setting a first one of the image forming conditions for said forming means, and a second key for setting a second one of the image forming conditions for said forming means;

means for controlling said forming means to change the image forming condition corresponding to the signal generated by said generating means in a first mode, and controlling said storing means to change the reference value stored in said storing means corresponding to the signal by the generating means in a second mode; and means for switching between the first and second modes of said controlling means.

3. An apparatus according to claim 2, further including means for selecting a specific level between a first level and a second level, said first level being prefixed and corresponding to one value of a quantity of the light radiated by said radiating means, and said second value being prefixed and corresponding to another value of a quantity of the light radiated by said radiating means.

4. An apparatus according to claim 2, further comprising:

means for detecting a condition of exposure to the original, said exposure being performed by said radiating means; and means for controlling an exposure condition o the original radiated by the radiated means in accordance with the exposure condition detected by said detecting means and a prescribed control target value;

wherein said forming means includes:

means for setting a mode for modifying the control target value of said controlling means;

means for modifying the control target value of said controlling means when the control target value modifying mode is set by said setting means; and means for retaining the control target value modified by said modifying means.

5. An image forming apparatus comprising:

means for radiating a light to an original;

means for detecting a quantity of the light reflected form the original;

means for storing a reference value of a quantity of the light;

means for determining the quantity of the light being radiated by said radiating means in accordance with a comparison of the quantity of light detected by said detecting means to the reference value stored in said storing means;

means for forming an image on an image carrier in one of a plurality of image forming conditions, using the light reflected from the original when said radiating means radiates the light in the quantity determined by the determining means;

wherein said forming means includes means for setting a mode for changing the image forming conditions of said forming means in accordance with a combination of said first and second keys;

means for modifying, using said second key, the image forming condition of said forming means when the image forming condition changing mode is set by said setting means; and means for retaining, using said first key, the image forming condition modified by said modifying means.

means for generating a signal;

wherein said generating means includes a first key for setting a first one of the image forming conditions for said forming means, and a second key for setting a second one of the image forming conditions for said forming means;

means for controlling said forming means to change the image forming condition corresponding tho the signal generated by the generating means in a first mode, and controlling said storing means to change the reference value stored in said storing means corresponding to the signal generated by the generating means in a second mode; and means for switching between the first and second modes of said controlling means.

6. An apparatus according to claim 5, further including means for selecting a specific level between a first level and a second level, said first level being prefixed and corresponding to one value of a quantity of the light radiated by said radiating means, and said second value being prefixed and corresponding to another value of a quantity of the light radiated by said radiating means.

7. An apparatus according to claim 5, further comprising:

means for detecting a condition of exposure to the original, said exposure being performed by said radiating means; and means for controlling an exposure condition of the original radiated by the radiated means in accordance with the exposure condition detected by said detecting means and a prescribed control target value;

wherein said forming means includes:

means for setting a mode for modifying the control target value of said controlling means;

means for modifying the control target value of said controlling means when the control target value modifying mode is set by said setting means; and means for retaining the control target value modified by said modifying means.

8. An image forming apparatus comprising:

means for radiating a light to an original;

means for detecting a quantity of the light reflected from the original;

means for storing a reference value of a quantity of the light;

means for determining the quantity of the light being radiated by said radiating means in accordance with a comparison of the quantity of light detected by said detecting means to the reference value stored in said storing means;

means for forming an image on an image carrier in one of a plurality of image forming conditions, using the light reflected form the original when said radiating means radiates the light in the quantity determined by the determining means;

means for generating a signal;

means for controlling said forming means to change the image forming condition corresponding tho the signal generated by the generating means in a first mode, and controlling said storing means to change the reference value stored in said storing means corresponding to the signal generated by the generating means in a second mode;

means for switching between the first and second modes of said controlling means;

means for detecting a density of a toner used by said forming means to form an image on the image carrier; and means for controlling the toner density used by said forming means in accordance with the toner density detected by said detecting means and a prescribed control target value;

and wherein said generating means includes a toner density key for setting the control target value of said controlling means;

and wherein said forming means includes means for setting a mode for modifying the control target value of said controlling means;

means for modifying the control target value of said controlling means when the control target value modifying mode is set by said setting means; and means for retaining the control target value modified by said modifying means.

9. An apparatus according to claim 8, further including means for selecting a specific level between a first level and a second level, said first level being prefixed and corresponding to one value of a quantity of the light radiated by said radiating means, and said second value being prefixed and corresponding to another value of a quantity of the light radiated by said radiating means.

10. An apparatus according to claim 8, further comprising:

means for detecting a condition of exposure to the original, said exposure being performed by said radiating means; and means for controlling an exposure condition of the original radiated by the radiated means in accordance with the exposure condition detected by said detecting means and a prescribed control target value;

wherein said forming means includes:

means for setting a mode for modifying the control target value of said controlling means;

means for modifying the control target value of said controlling means when the control target value modifying node is set by said setting means; and means for retaining the control target value modified by said modifying means.

* * * * *